United States Patent [19]

Kruelskie

[11] Patent Number: 4,928,839

[45] Date of Patent: May 29, 1990

[54] PLASTIC DRUMS FOR STORING OR TRANSPORTING LIQUID AND SOLID PRODUCTS

[75] Inventor: Donald A. Kruelskie, Baton Rouge, La.

[73] Assignee: The Dow Chemical Company, Midland, Mich.

[21] Appl. No.: 404,994

[22] Filed: Sep. 8, 1989

[51] Int. Cl.[5] ..... B65D 7/00

[52] U.S. Cl. ..... 220/5 R; 220/74; 206/503; 206/508

[58] Field of Search ..... 220/5 R, 72, 74, 83; 206/503, 507

[56] References Cited

U.S. PATENT DOCUMENTS

| | | | |
|---|---|---|---|
| 3,516,571 | 6/1970 | Roper et al. | 220/72 X |
| 3,987,926 | 10/1976 | Yavorsky | 220/74 X |
| 4,014,452 | 3/1977 | Galer | 220/74 |
| 4,033,473 | 7/1977 | Raley et al. | 220/74 X |
| 4,228,911 | 10/1980 | Hammes | 220/72 X |

*Primary Examiner*—Steven M. Pollard

*Attorney, Agent, or Firm*—V. Dean Clausen

[57] ABSTRACT

The invention refers to plastic drums designed such that the bottom of the drum will interlock with the lid of another drum. This feature enables the drums to be placed in stacks that are stable, so they can be safely handled during shipping, storing, or handling operations. The drums are also designed so they can be stored in a nesting column, when empty, without the drums becoming wedged together in the column.

9 Claims, 6 Drawing Sheets

PLASTIC DRUMS FOR STORING OR TRANSPORTING LIQUID AND SOLID PRODUCTS

BACKGROUND OF THE INVENTION

This invention relates to plastic drums for storing or transporting liquid and solid products. More specifically, the invention is directed to plastic drums having bottom-to-lid interlocking surfaces, which enable the drums to be placed in stacks that are both safe and stable during shipping or storing operations.

Plastic drums are commonly used in industry, particularly in chemical plants, to transport hazardous liquid and solid materials to disposal points, such as incinerators. Many of these drums have removable flat lids that are fastened to the drum with a ring clamp. When the drums are packed together inside a truck trailer, or on a pallet, the ring clamps are frequently damaged or dislodged from a drum. It's also quite difficult to use fork lift or parrotbeak equipment to move plastic drums that are filled with material. Lifting the drums with this type of equipment frequently loosens the ring clamp enough so that the lid drops off of the drum.

Another problem with plastic drums is the difficulty in trying to stack them to save space. When the drums are stacked, the flat bottom of the drum on top tends to slide on the flat lid of the drum on the bottom, so that the stack itself is very unstable. The flat lid can also collect water, or other liquids, which can be mistaken for hazardous waste materials.

SUMMARY OF THE INVENTION

The invention is a plastic drum that is both stackable and nestable. In one embodiment of the drum, it consists of an elongate, circular drum wall that tapers downwardly from the top end to the bottom end of the drum wall. The top end of the drum wall defines a lip portion. A removable, circular lid closes the top end of the drum wall and, at the bottom, the drum wall is closed by a bottom member that is joined to the drum wall. The lid has a convex profile and a hook structure is defined at its outer edge.

Along the top surface of the lid are formed two circular rib portions. The larger diameter rib portion is located adjacent to the hook structure, such that it surrounds the smaller diameter rib portion. The bottom member has a concave profile, and along the bottom surface of this member is formed a spline portion and a slot portion. The spline portion is formed at the periphery of the bottom member and it surrounds the slot portion.

The drum also includes a support ring that can be either fitted snugly to the outside surface of the drum wall, or it can be integral with the drum wall. The ring which is integral with the drum wall has a lip portion that extends out beyond the top of the drum wall. The lower end of the ring forms a base portion, which is a flat surface that lies perpendicular to the drum wall. The lower end of the ring forms a base portion, which is a flat surface that lies perpendicular to the drum wall.

When the drum described herein is stacked on top of another drum of similar design, the spline portion on the bottom member seats down against the large diameter rib portion in the lid of the drum on which it is stacked (bottom drum); and the slot portion seats down over the small diameter rib portion in the lid of the bottom drum. Since the bottom of the drum on top interlocks with the lid of the drum on which it is stacked, the drums are capable of being arranged in a very stable stack.

The drums described herein are also capable of being nested, when empty, in a very convenient nesting arrangement. In the nesting arrangement, when one drum is placed inside of another, the base portion of the support ring of the uppermost drum seats down against the lip portion of the drum immediately underneath it. The lip portion thus provides a "stop" member that keeps the nested drums from becoming wedged together.

DESCRIPTION OF THE INVENTION

Figure 1:
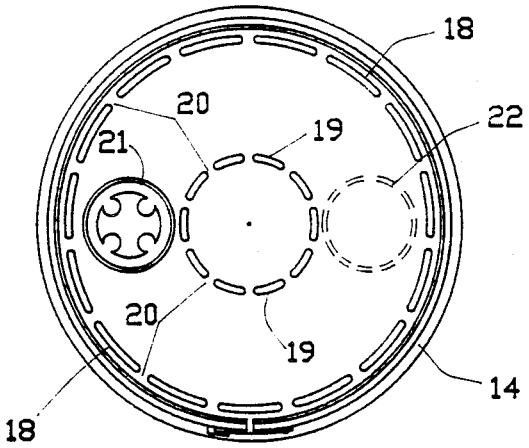
FIG. 1 is a plan view of one embodiment for the drum of this invention. This view illustrates particularly the surface configuration of the drum lid.

Referring to the drawings, particularly FIGS. 1–5, the numeral 10 indicates one embodiment of the plastic drum of this invention. The main component of the drum is an elongate circular drum wall 11. A removable circular lid 12 fits over the top end of the drum wall. The bottom end of the drum wall is closed by a bottom member 13, which is joined to the drum wall. The lid 12 is fastened to drum 10 by a conventional ring clamp 14. The drum wall 11 tapers downwardly from the top end to the bottom end (note particularly FIG. 3).

Figure 5:
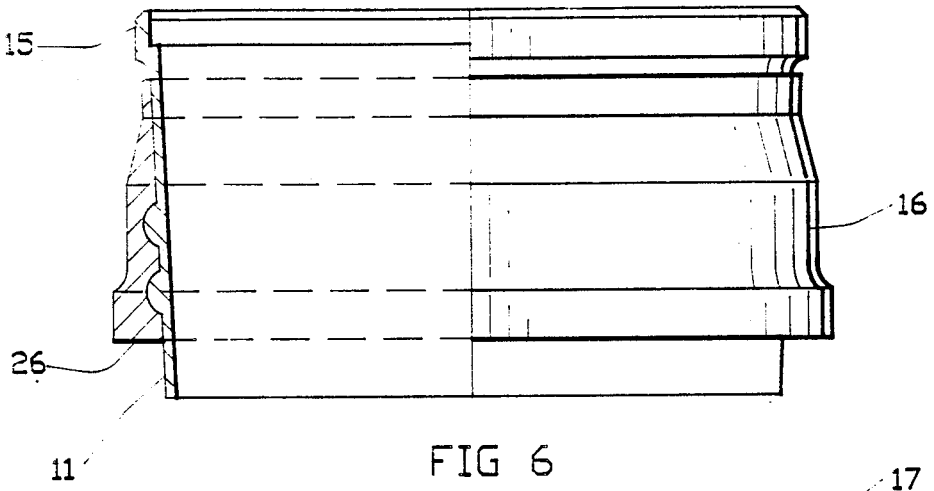
FIG. 5 is a fragmentary view, partly in section, of the top of one of the drums of this invention. This view illustrates how a removable support ring is fitted onto the drum near the top.
Figure 6:
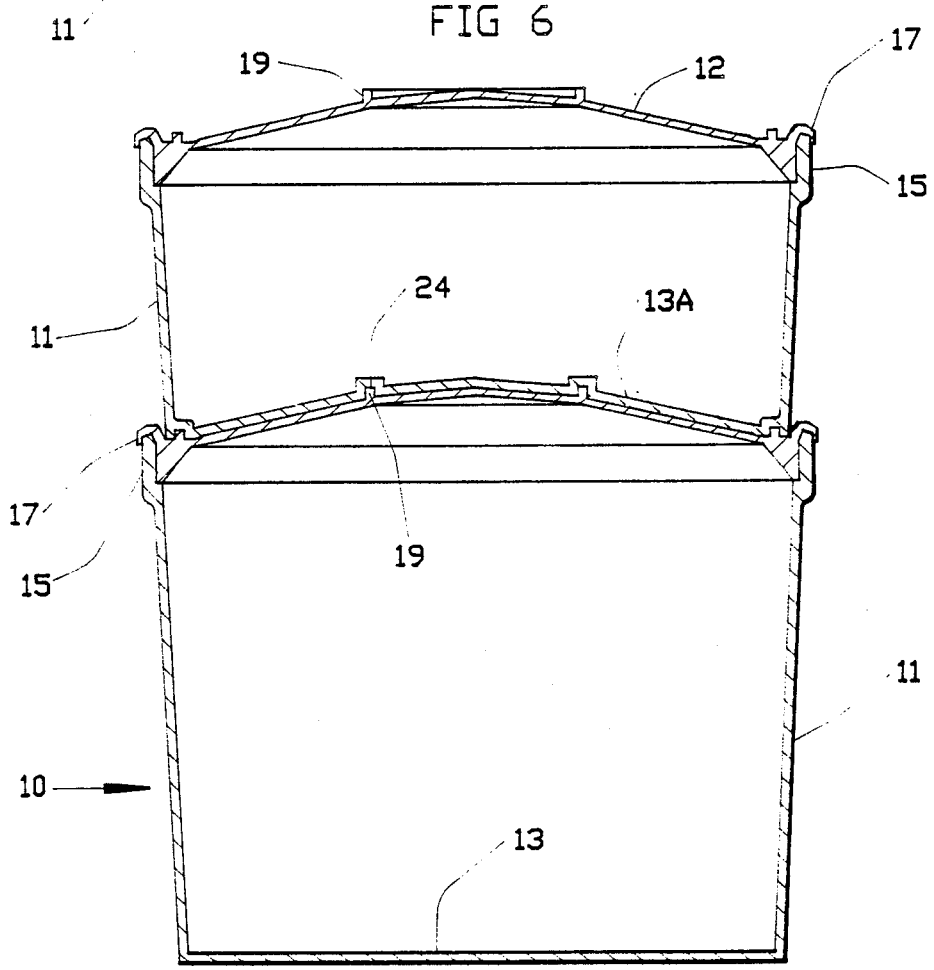
FIG. 6 is an elevation view, in section, showing a two-drum stack, in which the top drum is smaller than the drum on the bottom of the stack.

In the embodiment shown in FIGS. 5 and 6, a lip portion 15 is defined at the top end of the drum wall. The drum also includes a removable support ring 16, which is fitted snugly to the outside surface of the drum wall, just below the lip 15. The lid 12 has a convex profile, with a hook structure 17 being defined along the outer edge of the lid. When the lid is placed on a drum, the hook structure 17 fits down over the lip 15.

In the top surface of the lid 12 is formed a large diameter rib portion and a small diameter rib portion. The large diameter rib portion consists of spaced-apart rib segments 18, which are located adjacent to the hook structure 17. The small diameter rib portion is made up of spaced-apart rib segments 19, which are positioned near the center of lid 12, and which are surrounded by the larger rib portion 18.

The spaces between the rib segments 18 and 19 provide channels 20 that allow water or other liquids that may collect on the lid 12 to drain from the lid. The lid 12 also includes an inspection bung 21, which can be removed to inspect the contents of the drum, or to take a sample of the contents. As shown in FIG. 1, a second inspection bung, or a pressure relief device, could also be positioned in the lid 12 in the blank spot indicated by numeral 22.

Referring to FIG. 1, the bottom member 13 of the drum 10 has a flat profile. In the practice of this invention, the larger drums, i.e. from about 30 to 50 gallons capacity, are constructed with flat bottoms. The larger drums are always used as the bottom drum in a stack, and the flat bottoms prevent the stack from becoming unstable.

The drum of this invention is also constructed with a bottom member 13A, which has a concave profile, as shown in FIGS. 3, 4, 6 and 7. Looking particularly at FIG. 4, a spline portion 23 and a slot portion 24 are formed in the underside surface 25 of the member 13A. The spline portion is formed at the periphery of the underside surface, and it surrounds the slot portion, which is defined near the center of the member 13A.

Figure 4:
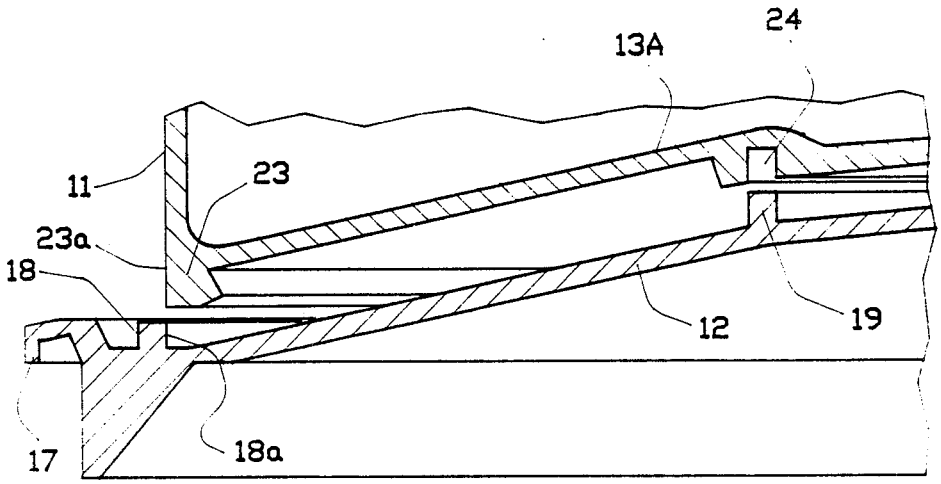
FIG. 4 is a detail view, as indicated by the circular line in FIG. 3, illustrating how the bottom of the top drum interlocks with the lid of the drum beneath it, to form a stable drum stack.

When the drums of this invention are stacked, the bottom member 13A of each drum will interlock with the lid 12 of the drum immediately beneath it, as best illustrated in FIG. 4. In the interlocking sequence, the outside surface **23*a* of spline portion 23, of the "top" drum, seats down against the inside surface 18*a* of the rib segments 18 on the lid 12 of the "bottom" drum. At the same time, the slot portion 24 in member 13A seats down over the segments 19 of the small diameter rib portion in lid 12**.

Figure 3:
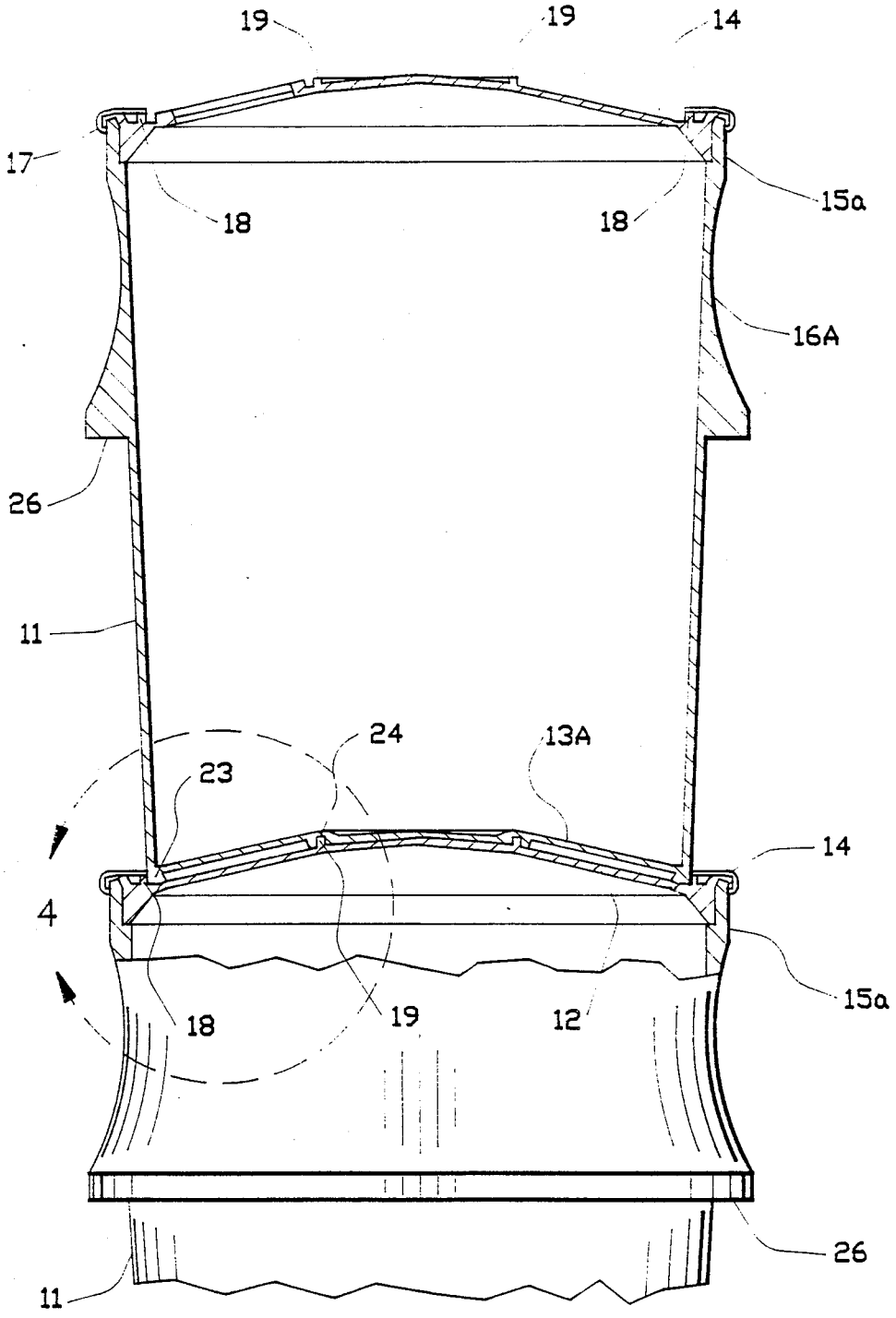
FIG. 3 is an elevation view, mostly in section, showing how the drums of this invention can be stacked, one on top of another.
Figure 7:
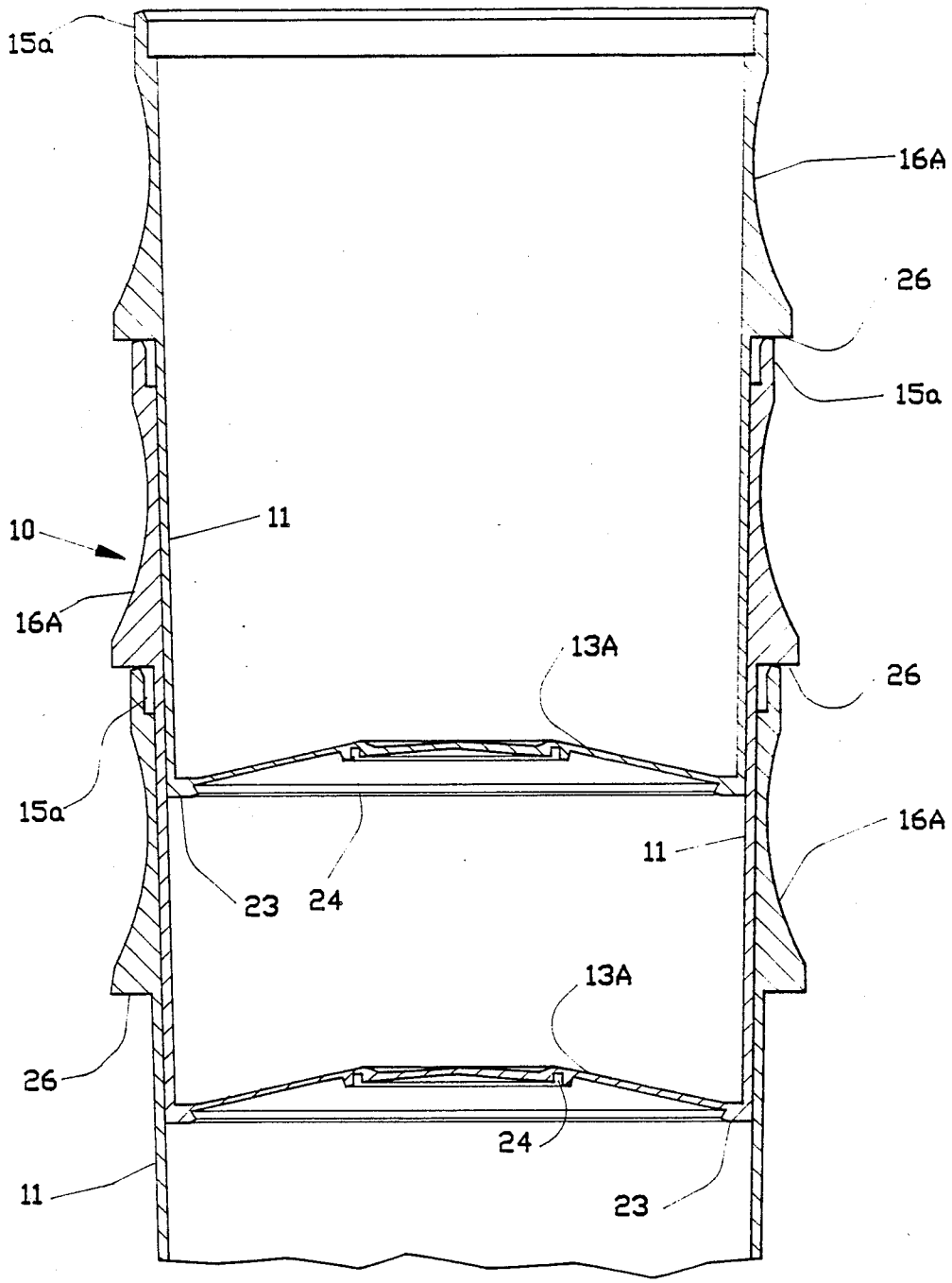
FIG. 7 is an elevation view, in section, of a stack of three empty drums, in which the drums are positioned in a nesting arrangement.

As described earlier, the drum shown in FIG. 5 includes a removable support ring 16, which is positioned on the outside surface of the drum wall 11 just below the lip 15. In another embodiment of the present drum, as shown in FIGS. 3 and 7, the drum is fabricated so that the support ring, indicated by numeral 16A, is integral with the drum wall 11. In this embodiment, the upper end of the support ring defines a lip portion **15*a*, that extends out beyond the top of the drum wall. The lower end of ring 16A forms a base portion defined by a flat surface 26 that lies perpendicular to the drum wall 11. The lower end of the removable support ring 16 has the same type of base, i.e. a flat surface 26**.

In the practice of this invention, a stable stack can be formed using drums of several different sizes. For example, drums ranging in size from 4 gallons to 55 gallons can be safely placed in the same stack. As illustrated in FIG. 6, the smaller drums are always placed on top of the larger drums.

In addition to being stackable, the drums of this invention can be stored in a convenient nesting arrangement. For example, as shown in FIG. 7, one drum is placed inside of another to form the nesting column. In this arrangement, the flat surface 26 on the support ring 16A of the uppermost drum will seat down against the lip portion **15*a*** of the drum immediately below it in the nesting column. This prevents the drums in the nesting column from becoming wedged (sticking) together.

In addition to preventing the nested drums from sticking together, the support rings 16 and 16A have other advantages. For example, the support rings add additional strength to each drum, which makes it possible to stack one drum on top of another. The support rings are also designed to be strong enough so that the forks of a fork lift truck can be slipped under the flat surface 26 of each ring (the base portion of the ring), to enable moving the drums from one place to another. The extra strength added by the support rings also makes it convenient to handle the drums with conventional parrotbeak equipment.

Figure 2:
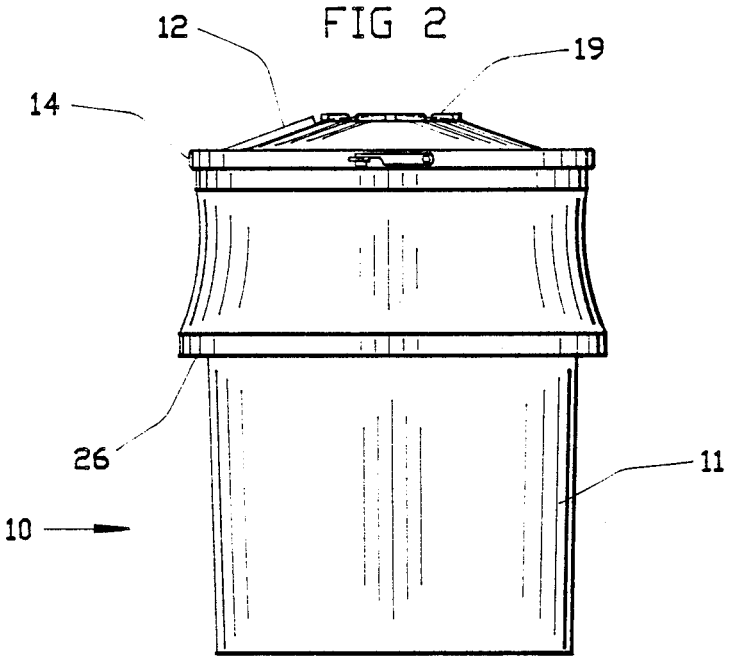
FIG. 2 is an elevation view of the drum shown in FIG. 1.

It will be noted also that the outside diameter of each support ring 16 or 16A is slightly larger than the outside diameter of the ring clamps 14, as best shown in FIG. 2. This feature keeps the ring clamps on each drum from banging against each other when the drums are handled, which can loosen or dislodge the clamps.

Figure 8:
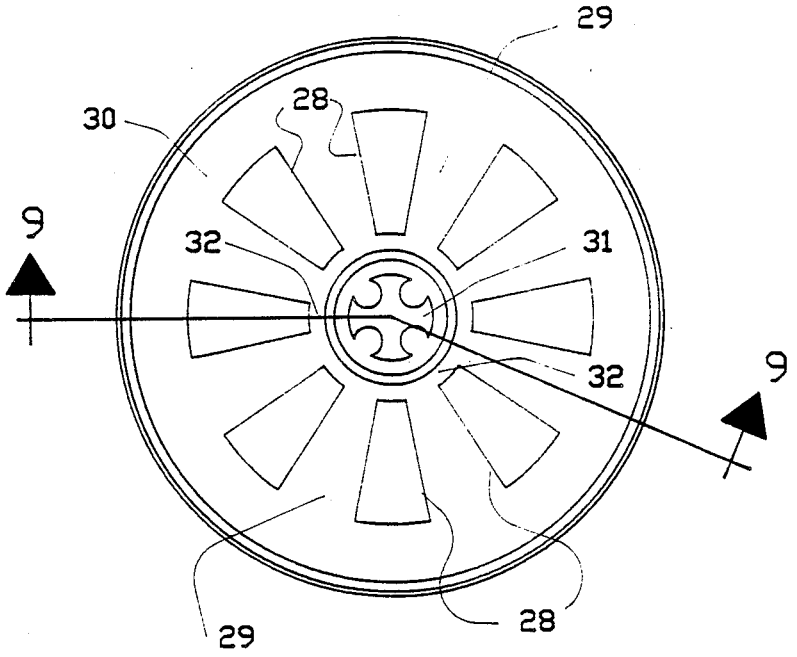
FIG. 8 is a plan view of another drum lid of this invention. The surface configuration on this drum lid is an alternative design to the lid configuration shown in FIG. 1.
Figure 9:
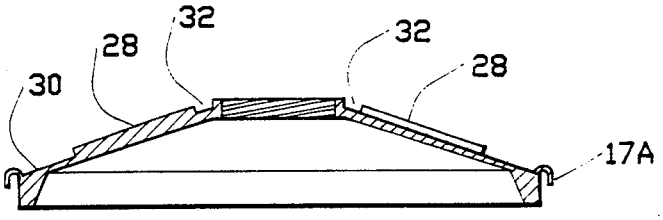
FIG. 9 is a cross-section view of the lid shown in FIG. 8, as taken along line 9—9.

A second embodiment of a removable circular lid for the drum 10 of this invention is illustrated in FIGS. 8 and 9. This lid, indicated by numeral 27, has a convex profile which is similar to the profile of lid 12, as described earlier. A hook structure 17A is defined at the outer edge of lid 27, and in the top surface of the lid is formed a group of paddle-shaped members 28, which are raised from the lid's surface. The members 28 are also spaced apart, such that a number of channels 29 are defined between the members. These channels provide for water or other liquids to drain off of the lid. Between the wide end of the members 28 and the hook structure 17A is a flat portion of the lid 12 that defines a shelf portion 30. At the center of the lid 27 is an inspection bung 31. Between the narrow end of the members 28 and bung 31 is a slot portion 32.

In the practice of this invention, another drum could be stacked on top of a drum which included the lid 27. To provide the desired interlocking sequence, as described earlier, the bottom member of the drum being seated on lid 27 would be designed with a concave profile similar to the bottom member 13A, which is shown in FIGS. 3, 4, 6 and 7.

A drum having a bottom member designed for interlocking with lid 27 is not illustrated herein. But, the bottom member of such a drum would have an underside surface in which is formed a first spline portion and a second spline portion. The first spline portion would be formed at the periphery of the bottom member, and it would be designed to seat down onto the shelf portion 30 of lid 27. The first spline portion would surround the second spline portion, which would be located near the center of the bottom member. And the second spline portion would be designed to seat down into the slot portion of lid 27.

Figure 10:
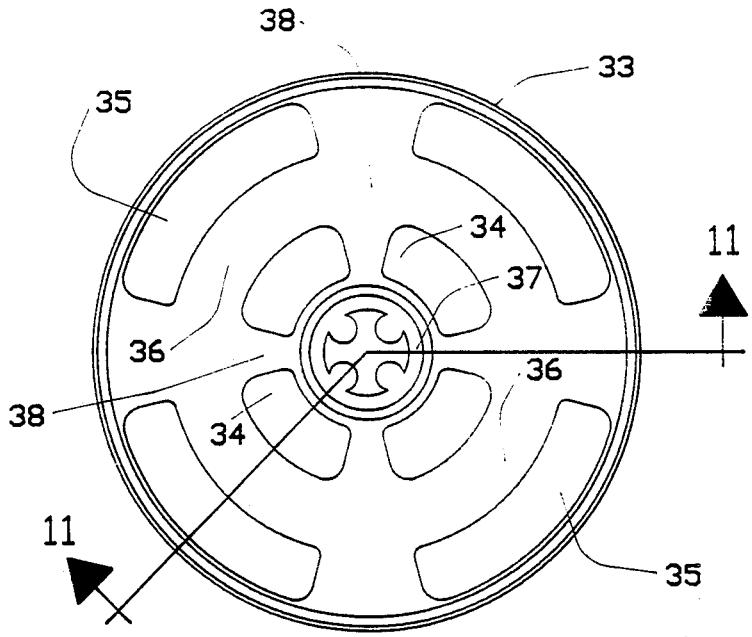
FIG. 10 is a plan view of another drum lid of this invention. The surface configuration on this drum lid is an alternative design to the lid configurations shown in FIGS. 1 and 8.
Figure 11:
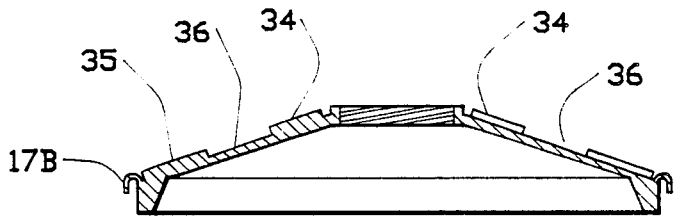
FIG. 11 is a cross-section view of the lid shown in FIG. 10, as taken along line 11—11.

A third embodiment of a removable circular lid for the drum 10 of this invention is illustrated in FIGS. 10 and 11. This lid, as indicated by numeral 33, has a convex profile similar to the profile of the lids 12 and 27, as described above. A hook structure 17B is defined at the outer edge of lid 33, and in the top surface of the lid are formed two sets of crescent-shaped members, which are raised from the lid's surface. The smaller, or minor set of the crescent-shaped members, as indicated by numeral 34, is located near the center of the lid. Numeral 35 indicates the larger, or major set of the crescent-shaped members, which is located adjacent to the hook structure 17B.

As shown particularly in FIG. 10, there is a space between the members 34 and 35, which forms a wide slot portion 36. An inspection bung 37 is located at the center of lid 33. It will also be noted from FIG. 10 that there is a space between each of the members 34 in the minor set, and each of the members 35 in the major set. These spaces, indicated by numeral 38, provide channels for water or other liquids to drain off of the lid 38.

According to the practice of this invention, another drum could be stacked on top of a drum which included the lid 33. A drum suitable for stacking on top of lid 33 would have a bottom member with a concave profile similar to the bottom member 13A, so that it could interlock with the lid 33. A drum designed for stacking on top of lid 33 is not illustrated herein. But, the bottom member of such a drum would have an underside surface in which is formed a wide spline portion, and the spline portion would be designed to seat down into the wide slot portion 36.

The drums of this invention can be constructed of any of several polymer compositions that are rigid, strong, impermeable to chemical attack, and resistant to high temperature. The polymer compositions should also be capable of being blow molded or injection molded. High density polyethylene compositions are particularly suitable for this purpose.

The invention claimed is:

1. A stackable drum fabricated of a plastic material, which comprises:

an elongate, circular drum wall that tapers downwardly from the top end to the bottom end of the drum wall;

a removable circular lid for closing the top end of the drum wall;

a bottom member joined to the bottom end of the drum wall, for closing the drum wall;

the drum wall having an outside surface, and the top end of the drum wall defining a lip portion;

a removable support ring that fits snugly against the outside surface of the drum wall, and the ring being positioned just below the lip portion of the drum wall;

the circular lid having a convex profile, and an outer edge that defines a hook structure;

the circular lid having a top surface in which is formed a large diameter rib portion, and a small diameter rib portion;

the large diameter rib portion of the lid being located adjacent to the hook structure, and the small diameter rib portion of the lid being surrounded by the large diameter rib portion;

the bottom member having a concave profile, and an underside surface in which is formed a spline portion and a slot portion;

the spline portion being formed at the periphery of the bottom member, and the slot portion being surrounded by the spline portion;

wherein, the hook structure on the lid of the drum defined herein is adapted to seat down onto the lip portion of the drum wall;

the spline portion on the bottom member of the drum defined herein is adapted to seat down against the large diameter rib portion in the lid of another drum having a similar design;

the slot portion on the bottom member of the drum defined herein is adapted to seat down over the small diameter rib portion in the lid of another drum having a similar design;

such that the drum defined herein is adapted for combining with other drums of a similar design to provide a stable drum stack.

2. The drum of claim 1 in which the removable support ring has a lower end that forms a base portion defined by a flat surface that is perpendicular to the outside surface of the drum wall.

3. The drum of claim 1 which includes a support ring integral with the drum wall, the ring having an upper end and a lower end, the upper end defining a lip portion that extends out beyond the top of the drum wall, and the lower end forming a base portion defined by a flat surface that lies perpendicular to the drum wall.

4. The drum of claim 3 which is capable of being nested with other drums having a similar design, wherein, in the nesting step:

the drum of claim 3 is adapted for placing inside another drum having a similar design, such that the base portion of the support ring of the drum of claim 3 seats down against the lip portion of the other drum, to thereby keep the drum of claim 3 from becoming wedged inside the other drum.

5. A stackable drum fabricated of a plastic material, which comprises:

an elongate, circular drum wall that tapers downwardly from the top end to the bottom end of the drum wall;

a removable circular lid for closing the top end of the drum wall;

a bottom member joined to the bottom end of the drum wall, for closing the drum wall;

the drum wall having an outside surface, and the top end of the drum wall defining a lip portion;

a removable support ring that fits snugly against the outside surface of the drum wall, and the ring being positioned just below the lip portion of the drum wall;

the circular lid having a convex profile, and an outer edge that defines a hook structure;

the circular lid having a top surface in which is formed a shelf portion and a slot portion;

the shelf portion of the lid being located adjacent to the hook structure, and the slot portion of the lid being surrounded by the shelf portion;

the bottom member having a concave profile, and an underside surface in which is formed a first spline portion, and a second spline portion;

the first spline portion being formed at the periphery of the bottom member, and the second spline portion being surrounded by the first spline portion;

wherein, the hook structure on the lid of the drum defined herein is adapted to seat down onto the lip portion of the drum wall;

the first spline portion on the bottom member of the drum defined herein is adapted to seat down onto the shelf portion in the lid of another drum having a similar design;

the second spline portion on the bottom member of the drum defined herein is adapted to seat down into the slot portion in the lid of another drum having a similar design;

such that the drum designed herein is adapted for combining with other drums of similar design to provide a stable stack of drums.

6. The drum of claim 5 in which the slot portion and the shelf portion of the circular lid are defined at opposite ends of paddle-shaped members that are raised from the lid surface, the raised members being spaced apart to form a channel between each of said members.

7. A stackable drum fabricated of a plastic material, which comprises:

an elongate, circular drum wall that tapers downwardly from the top end to the bottom end of the drum wall;

a removable circular lid for closing the top end of the drum wall;

a bottom member joined to the bottom end of the drum wall, for closing the drum wall;

the drum wall having an outside surface, and the top end of the drum wall defining a lip portion;

a removable support ring that fits snugly against the outside surface of the drum wall, and the ring being positioned just below the lip portion of the drum wall;

the circular lid having a convex profile, and an outer edge that defines a hook structure;

the circular lid having a top surface in which is formed a wide slot portion;

the bottom member having a concave profile, and an underside surface in which is formed a wide spline portion;

wherein, the hook structure on the lid of the drum defined herein is adapted to seat down onto the lip portion of the drum wall;

the wide spline portion on the bottom member of the drum defined herein is adapted to seat down into the wide slot portion in the lid of another drum having a similar design;

such that the drum defined herein is adapted for combining with other drums of similar design to provide a stable drum stack.

8. The drum of claim 7 in which the wide slot portion of the circular lid is formed by a space between a minor set and a major set of crescent-shaped members, each set of crescent-shaped members being raised from the lid surface, and the raised members within each major and minor set being spaced apart to define a channel between each of said sets.

9. The drum of claim 1 in which the large diameter and small diameter rib portions of the circular lid are defined by rib segments that are spaced apart to form channels between each of said rib segments.

* * * * *